US005198863A

United States Patent [19]

Goto et al.

[11] Patent Number: 5,198,863

[45] Date of Patent: Mar. 30, 1993

[54] IMAGE FORMING APPARATUS

[75] Inventors: Masahiro Goto, Kawasaki; Koichi Hiroshima, Yokohama, both of Japan

[73] Assignee: Canon Kabushiki Kaisha, Tokyo, Japan

[21] Appl. No.: 715,702

[22] Filed: Jun. 17, 1991

Related U.S. Application Data

[63] Continuation of Ser. No. 371,815, Jun. 27, 1989, abandoned.

[30] Foreign Application Priority Data

Jun. 29, 1988 [JP] Japan ..... 63-161184

[51] Int. Cl.[5] ..... G03G 15/16

[52] U.S. Cl. ..... 355/274; 355/271; 355/275; 355/276; 355/277

[58] Field of Search ..... 355/277

[56] References Cited

U.S. PATENT DOCUMENTS

| | | | |
|---|---|---|---|
| 3,647,292 | 3/1972 | Weikel, Jr. | 355/274 |
| 4,063,808 | 12/1977 | Simpson | 355/274 |
| 4,407,580 | 10/1983 | Hashimoto et al. | 355/275 |
| 4,571,052 | 2/1986 | Shirai | 355/274 |
| 4,666,804 | 5/1987 | Haneda et al. | 430/126 X |
| 4,821,067 | 4/1989 | Oushiden et al. | 355/268 X |

FOREIGN PATENT DOCUMENTS

| | | | |
|---|---|---|---|
| 57-27286 | 2/1982 | Japan | 355/275 |
| 61-232478 | 10/1986 | Japan | 355/271 |

*Primary Examiner*—A. T. Grimley
*Assistant Examiner*—Matthew S. Smith
*Attorney, Agent, or Firm*—Fitzpatrick, Cella, Harper & Scinto

[57] ABSTRACT

An image forming apparatus includes a movable photosensitive member having a photosensitive layer of an organic photoconductor, a device for forming an image on a surface of the photosensitive member, a device for transferring the image formed on the photosensitive member by the image forming device onto a transfer material, the transfer device including a rotatable transfer member having a dielectric surface for moving the transfer material while contacting it to the surface of the image bearing member at a transfer position and an electrode for forming an electric field, the electrode being contacted to a surface of the rotatable transfer member remote from the photosensitive member.

41 Claims, 4 Drawing Sheets

FIG. 5A
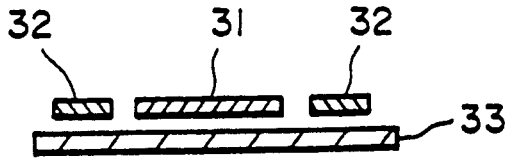
FIG. 5B
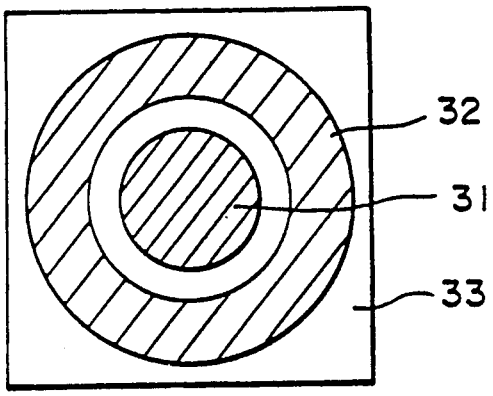
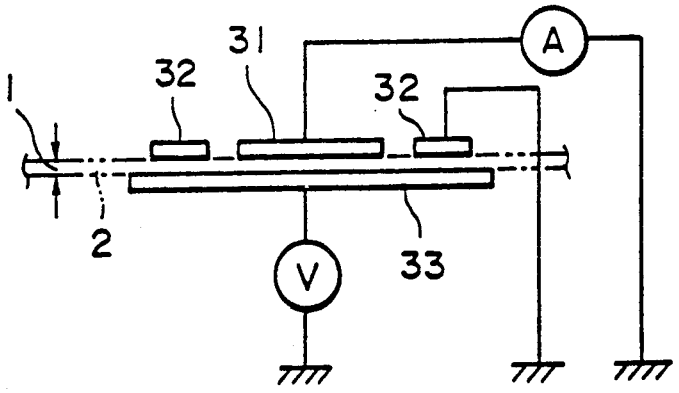
FIG. 6

IMAGE FORMING APPARATUS

This application is a continuation of application Ser. No. 371,815 filed Jun. 27, 1989, now abandoned.

FIELD OF THE INVENTION AND RELATED ART

The present invention relates to an image forming apparatus such as an image transfer type electrophotographic recording apparatus (copying machine and printer), wherein a transferable image is formed on an image bearing member by known image forming process means, and is transferred onto a transfer material, so that an image is formed on the transfer material.

Recently, organic photoconductors, which will hereinafter be called "OPC", have become widely used as a photosensitive member functioning as an image bearing member in an electrophotographic recording apparatus. This is because the manufacturing cost of OPC is low, because mass-production of OPC is easy and because it is recently improved in sensitivity and durability. In addition, it is relatively easy for increasing the sensitivity of the OPC in the near infrared region, and therefore, it is widely used for a photosensitive member in a laser beam printer (LBP). In the electrophotographic recording apparatus using the OPC as the image bearing member, the used transfer means is of a corona transfer type using a corona charger or a roller transfer type using a conductive roller.

The OPC has the following drawbacks when it is used as the photosensitive member:

(1) Where it has a mainly positive or negative charging property, it does not exhibit the photoconductivity with respect to the charge of the polarity opposite to the charging property. More particularly, when, for example, it has the negative charging property, the positive charge with which it is charged is not easily dissipated by light:

(2) When the OPC is exposed to ozone, the surface layer is deteriorated with the result of lower surface resistance, and therefore, it becomes difficult to charge, so that the image formed is blurred: and (3) The OPC easily catches paper dust or the like on its surface layer, and therefore, when the paper dust or the like absorbs moisture and is exposed to ozone, the electric resistance becomes lower. As a result, it becomes difficult to electrically charge the OPC, so that the image tends to be blurred ("flow" of image).

Because of the above drawbacks, the conventional image transfer systems involve the following problems. In the system such as a laser beam printer, wherein the area exposed to the laser beam attract the toner (reverse development), the OPC is first uniformly charged to a negative polarity, if the OPC has the negative charging property. The portions of the OPC photosensitive member which are to attract the toner are exposed to the laser beam by a laser scanner, by which the electric potential of the exposed portions is attenuated, so that a latent image is formed. The latent image then is developed with negative toner. Therefore, the image transfer is performed with a transfer charger capable of positive charging, that is, opposite to the polarity of the toner. As described hereinbefore, the OPC does not show the photoconductivity to the positive charge in this space, and therefore, even if it is exposed to uniform light, the positive charge remains (positive charge memory).

Then, a potential difference is produced on the image bearing member surface depending on the absence and presence of the transfer material at the transfer position, that is, between the positively charged portion and not charged portion (trace of sheet). To obviate this problem, it is known that the transfer charge is weakened to reduce the positive charge applied to the photosensitive member, by which the trace is decreased, and that the duration of the transfer charge application is changed in accordance with the length of the transfer material in the direction of the transfer material movement. More particularly, the transfer charge is applied when the transfer material is present at the transfer position, but the transfer charge is not effected when there is no transfer material. However, the former involves a problem of insufficient image transfer efficiency and a problem that the image is easily disturbed during conveyance of the transfer material because the toner retaining force on the transfer material after the image transfer is weak. The latter does not solve the problem that it can not meet the variation of the width of the transfer material. Also, it still involves the problem of the trace of sheet stemming from sudden change of the electric field at an edge of the transfer material. The above equally applies to the corona transfer and the roller transfer since they directly apply the positive charge to the OPC.

When a corona type transfer system is used, ozone is produced thereby with the result of the problems stated in the paragraphs (2) and (3) being more remarkable. This is further remarkable when the corona charge is of negative polarity. When the roller type transfer system is used, the production of ozone is smaller, but since a high voltage is directly applied on the OPC surface layer, it involves the danger of pin hole production in the surface layer. If the pin hole is produced, an excessive current flows, so that the charging is not effected.

As an additional drawback of the OPC, the friction coefficient is higher than that of the other photosensitive member. Therefore, when the transfer material is paper, for example, the paper dust is more easily attached on the OPC, and therefore, the problem of the above paragraph (3) easily arises. In order to remove the paper dust, it is necessary to scrape the OPC surface with one or another means.

In the developing system wherein a one component developer is used and wherein the photosensitive member and a developing roller are out of contact, which is recently widely used, the developing device does not have a function of scraping the OPC surface, and therefore, the above problem is more remarkable. It is considered that the hardness of the OPC surface is reduced or that the OPC surface is strongly scraped by a rubber roller or a sponge roller or the like. If, however, this is done, the durability of the OPC is decreased.

The OPC is more adhesive to the transfer material than the other photosensitive materials, and therefore, the transfer material is not easily separated from the OPC after the image transfer. Therefore, the usual discharge separating system does not have a sufficiently wide separation latitude. Therefore, the image re-transfer (the toner once transferred onto the transfer material is transferred back to the photosensitive member) and improper separation (the transfer material is not sufficiently separated from the photosensitive member and is jammed) occur more easily. If a separation pawl or a separation belt is used as an auxiliary separating means, the surface of the OPC is easily damaged by the auxiliary means since the hardness of the OPC surface is not so high.

SUMMARY OF THE INVENTION

Accordingly, it is a principal object of the present invention to provide an image forming apparatus by which good images can be produced without blurring or flow of the image.

It is another object of the present invention to provide an image forming apparatus wherein the transfer material is easily and stably separated from the image bearing member and conveyed out therefrom.

It is a further object of the present invention to provide an image forming apparatus using an OPC material as a photosensitive member, wherein the OPC material can be used for a long period of time with the advantage of the properties of the OPC.

It is a further object of the present invention to provide an image forming apparatus wherein the charge memory of the image bearing member resulting from the presence and absence of the transfer material at the transfer position, and the resultant trace of the transfer material, are not produced.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 5A is a sectional view and FIG. 5B is a top plan view of a resistance measuring device.

FIG. 6, shows a circuit for measuring an electric resistance.

DETAILED DESCRIPTION OF THE PREFERRED EMBODIMENTS

Figure 1:
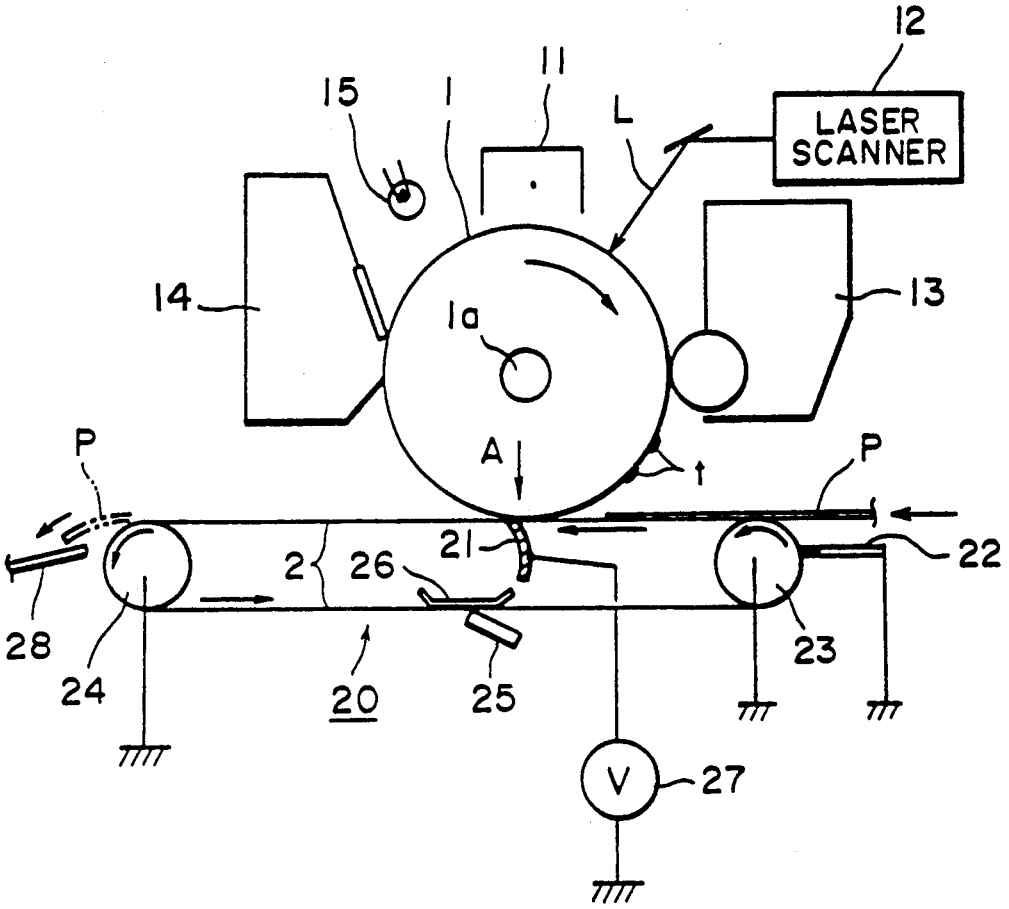
FIG. 1 is a sectional view of an image forming apparatus according to an embodiment of the present invention.

Referring now to FIG. 1, there is shown an exemplary image forming apparatus in the form of a laser beam printer, which comprises a photosensitive drum 1 functioning as an image bearing member and is rotated at a predetermined peripheral speed (process speed) in the clockwise direction (arrow) about its longitudinal central axis 1*a*.

The photosensitive drum 1 has a photosensitive layer of the OPC in this embodiment. The photosensitive drum 1 is of a laminated structure of a function allocated type and includes a charge generating layer (CGL) and a charge transfer layer (CTL). The CGL contains a phthalocyanine compound and has a thickness of 0.2–0.3 micron. The CTL thereon contains polycarbonate in which hydrazone compound is dispersed, and has a thickness of 15–25 microns. The OPC material exhibits a negative charging property.

The OPC drum 1, while being rotated, is subjected to a negative corona charging operation by a primary charger 11, so that the surface thereof is uniformly charged to a potential from −500 to −800 V.

The uniformly charged surface is exposed by a laser scanner 12 to a scanning laser beam L which is modulated in accordance with time series electric picture element signals carrying a desired image. By this, the electric charge at the exposed portion attenuates, so that an electrostatic latent image corresponding to the desired image is formed.

The latent image is then developed by a developing device 13. In the developing device 13, one component magnetic toner is applied on a sleeve in the form of a thin layer, and the thin layer of the toner is opposed to the OPC drum 1 without contact therebetween and with an alternating electric field formed between the sleeve and the OPC drum 1. The OPC drum 1 is reverse-developed with the toner which is charged to the negative polarity, that is, to the same polarity as the charging property of the OPC material. More particularly, the toner is deposited on such areas as have been exposed to the laser beam. The toner image is designated by a reference character t and is a visualized image formed on the surface of the OPC drum 1.

The toner image t is sequentially transferred onto a surface of the transfer material P at an image transfer station A containing a transfer and conveying device 20 which will be described in detail hereinafter.

The portion of the OPC drum surface having passed by the transfer station (position) A is cleaned by a cleaner 14 so that the remaining toner and other foreign patters thereon are removed. Then, the exposure hysteresis and the charge hysteresis of the OPC drum 1 is dissipated by a pre-exposure device 15 in the form of LED (light emitting diode) and fuse lamp or the like, so that the OPC drum 1 is prepared for the repeated image formation process.

The transfer and conveying device 20 mentioned hereinbefore includes a transfer belt 2 in the form of an endless belt which functions as a rotatable image transfer member and is disposed extended below the OPC drum 1. The transfer belt 2 is stretched around and between rollers 23 and 24, and one of the rollers 23 and 24 is a driving roller by which the transfer belt is revolved in the counterclockwise direction (arrow) at substantially the same peripheral speed as the OPC drum 1. The surface of the top portion of the transfer belt 2 is contacted, substantially at its central portion in the direction of its movement, to the bottom portion of the OPC drum 1 at the image transfer station A with a predetermined pressure. At least one of the rollers 23 and 24 is electrically conductive and is grounded.

The device 20 further includes an electrically conductive elastic blade (electrode) for producing an electric field for the image transfer. The blade 21 is disposed at a side of the top portion of the belt 2 from the side contacted to the OPC drum at the image transfer station A where the OPC drum 1 and the transfer belt 2 are contacted. The blade 21 is contacted to the back side of the top portion of the belt 2 with a predetermined pressure. The conductive and elastic blade 21 is supplied with a voltage by a voltage applying source 27 which is effective to apply to the blade 21 a voltage which is positive, that is, the opposite polarity to the toner image t.

The device 20 further includes another blade 25 for cleaning the transfer belt 2. It is contacted to substantially the center (in the direction of the movement) of the bottom portion of the belt 2 at its outside surface. To the opposite side from the cleaning blade 25, a back-up plate 26 is contacted to the backside of the belt 2. A discharging brush 22 is provided in contact with the outside surface of the belt at the portion contacted to the roller 23.

The transfer material P (usually a sheet material made of paper) is fed to the top portion of the transfer belt 2 from an unshown transfer material feeder from the right side of the belt 2, one by one.

The fed transfer material P is conveyed to an image transfer station A by the rotation of the belt 2, and is passed through the nip formed between the OPC drum 1 and the belt 2. During the passage, the toner image T is sequentially transferred from the OPC drum 1 surface to the transfer material P (FIG. 2), by the electric field produced by the conductive and elastic blade 21 which is supplied with a voltage of a polarity opposite to that of the toner from the power source 27 and which is contacted to the back side of the belt 2, at the image transfer station A.

The transfer material P having received the image at the image transfer station A is separated from the surface of the drum 1 due to the curvatures of the belt 2 and the drum 1. By the electric discharge at the time of the separation, the transfer material P is electrostatically attached to the belt 2 surface with stability, and therefore, it is conveyed to the left by the continuing rotation of the belt 2. At the left end of the belt 2, the transfer material P is separated from the belt surface due to the curvature of the roller 24 there and the resiliency of the transfer material. It is then introduced into an unshown image fixing device through a guide 28.

The contamination such as toner particles on the outer surface of the belt 2 is removed by the cleaner blade 25, and the electric charge accumulated on the belt is removed by the conductive rollers 23 and 24 and the discharging brush 22. The transfer belt 2 in this embodiment is of polyethylene terephthalate having a volume resistivity of not less than $10^{16}$ ohm·cm which is extruded into a tube and is thereafter biaxial-stretched. The belt produced in this manner has a tensile strength of not less than 1000 kg/cm$^2$ uniformly in the circumferential direction and longitudinal direction of the belt. Not less than 30 micron thickness of the belt is sufficient to provide the strength required for the transfer belt. From the standpoint of preventing a snaking movement of the belt, thicker is better, but from the standpoint of the image transfer efficiency, the image quality and the required capacity of the high voltage source, thinner is better. In this embodiment, a thickness of 70–120 microns of the belt 2 showed good results.

The usable materials for the elastic blade 21 are conductive rubbers such as EPDM, urethane rubber and chloroprene, and conductive elastomer such as polyolefin elastomer, urethane elastomer and polyester elastomer. The thickness thereof is 0.1–1 mm, the hardness is 40–90 degrees (JIS A), and the resistance is not more than $10^6$ ohm·cm. To the elastic blade 21, a voltage of 1–5 KV is applied. In order to meet variations in the ambience and the materials of the transfer material, it is preferable to control the current from the conductive blade 21 to the transfer belt 2 at a constant level, from the standpoint of stabilization of the transfer efficiency and the image quality. The experiments by the inventors have shown that the current I (micro-ampere) from the conductive blade 21 to the transfer belt 2 preferably satisfies the following:

$$5\times10^{-5}L\ Vp \leqq I1\times10^{-3}\times L\ Vp\ (\text{mm/sec})$$

Vp is a sheet conveyance speed; and L (mm) is a maximum usable width of the transfer material (the dimension measured in the direction perpendicular to the direction of the transfer material conveyance).

If $I \leqq 5\times10^{-5}LVpp$, the image transfer was not sufficient, and if $I > 1\times10^{-3}LVp$, partial void of image transfer occurred, which was considered as being attributable to the toner being positively charged.

The contaminations such as toner particles on the surface of the transfer belt 2 are removed by the cleaner 25, as described hereinbefore. Here, the rubber blade in this embodiment is contacted to the belt 2 surface in a counter-direction to allow efficient cleaning. The contact of the blade 25 to the surface of the belt 2 is stabilized by the back-up plate 26.

The rollers 23 and 24 and the discharging brush respectively remove the transfer charge accumulated on the transfer belt 2 and the charge (having the polarity opposite to the transfer charge) which is produced by the discharge at the time of separation between the transfer belt 2 and the OPC drum 1 and at the time of the separation between the transfer material P and the transfer belt 2 and which is accumulated on the surface of the belt.

Use of the transfer and conveying device having the structure described above produces the following advantages. Since the transfer belt 2 is highly insulative (the volume resistivity thereof is not less than $10^{16}$ ohm/cm) (polyethylene terephthalate), the transfer charge is not injected into the OPC drum 1. The discharge occurring at the time of separation between the OPC drum 1 and the transfer belt 2 is effective to apply to the OPC drum 1 the electric charge having the same polarity as the transfer charge, but the amount of charge produced by the separation discharge is small because the transfer belt 2 is highly insulative and because the electrostatic capacity of the transfer belt 2 is small at the place where the separation discharge is produced.

Therefore, the OPC drum 1 is hardly charged to the positive polarity, and the problems of the positive charge memory and the trace of the sheet do not arise. Accordingly, the conductive elastic blade 21 can be supplied with a sufficiently high voltage, so that a high image transfer efficiency can be provided. Thus, the toner after the image transfer can be retained with strong force, and good image quality can be maintained.

The present invention is advantageous even in the case where the photosensitive member is not made of the OPC material, but is made of a material such as selenium and amorphous silicon, if the photosensitive member exhibits a certain charging property upon reverse-development. This is because the rotatable transfer member having the surface dielectric layer is effective to prevent the charge memory and the trace of the sheet.

In this embodiment, the transfer electric field is applied by the elastic blade 21 from the inside of the transfer belt 2, and therefore, the ozone is hardly produced, and the very small amount of ozone unavoidably produced is not deposited onto the drum because of the existence of the transfer belt 2. Therefore, the image blurring attributable to ozone produced by the transfer charge, can be avoided.

Figure 2:
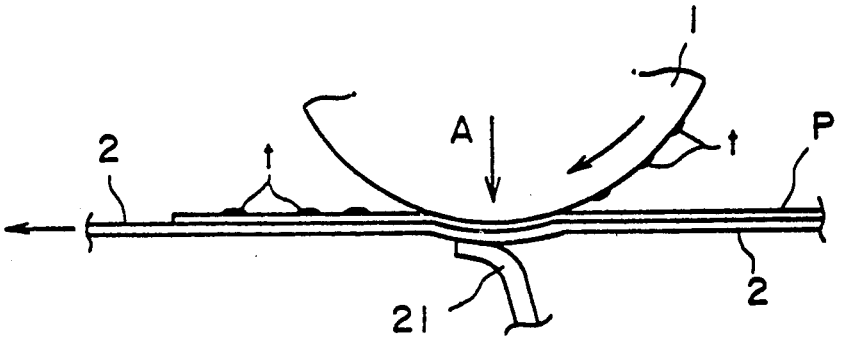
FIG. 2 is an enlarged sectional view of a transfer station of FIG. 1 apparatus.

As shown in FIG. 2, the transfer belt 2 is flexible at the portion where it is contacted to the OPC drum 1, so that sufficient width of the nip can be assured, and therefore, the close-contactness among the OPC drum 1, the transfer material P and the transfer belt 2 is very good. Because of this and because of the strong electrostatic attraction force from the transfer belt 2, the paper dust (when the transfer material P is made of paper), is attracted to the transfer belt 2 side, and therefore, it is hardly transferred to the OPC drum 1. In addition, since it does not directly apply the charge to the sheet, as contrasted to the case of the transfer corona discharger, the paper dust on the OPC drum 1, if any, is retained there only by physical van der Waals forces which are weak, and therefore, it can be easily removed by the cleaning device or the like. Therefore, the "flow" of the image attributable to the paper dust on the OPC drum which absorbs moisture and is exposed to the ozone and therefore is low in resistivity, hardly occurs. The experiments by the inventors, wherein electrophotographic machines having the same structure except for the image transfer device were continuously operated under the condition of 35° C. and 85% relative humidity, showed that when the image transfer device was of a corona transfer type, the flow of the image occurred when 1000–3000 sheets were processed; when the transfer device was a roller transfer type, the flow of the image occurred when 2000–5000 sheets are processed; and with the structure of the present invention, the flow of the image did not occur even after not less than 10000 sheets were processed. It has been found preferable as a result of the investigation by the inventors that the sufficiently wide close-contact is assured between the OPC drum 1 and the transfer belt 2, more particularly, the nip width is preferably not less than 3 mm.

In this system, the transfer material P is attracted by a strong electrostatic force from the transfer belt 2, and therefore, improper separation of the transfer material P from the OPC drum 1 as in the conventional structure does not occur, and the stabilized conveyance of the transfer material is assured.

It is also preferable that the movement of the charge in the transfer belt 2 is small, that the strong coulomb force can be applied to the transfer material P; sufficient close-contact is assured between the transfer belt 2 and the OPC drum 1. The investigations by the inventors have revealed that it is preferable that the surface of the transfer belt 2 contactable to the OPC drum 1 has the volume resistivity of not less than $10^{10}$ ohm·cm, and that the transfer belt 2 is made flexible at the portion where it is contacted to the OPC drum 1 to assure the sufficiently large nip.

In order to further enhance the advantages of the present invention, it is preferable that the ozone product is not deposited onto the surface of the transfer belt 2, and therefore, it is preferable that the transfer charge is effected within the transfer belt 2.

Figure 3:
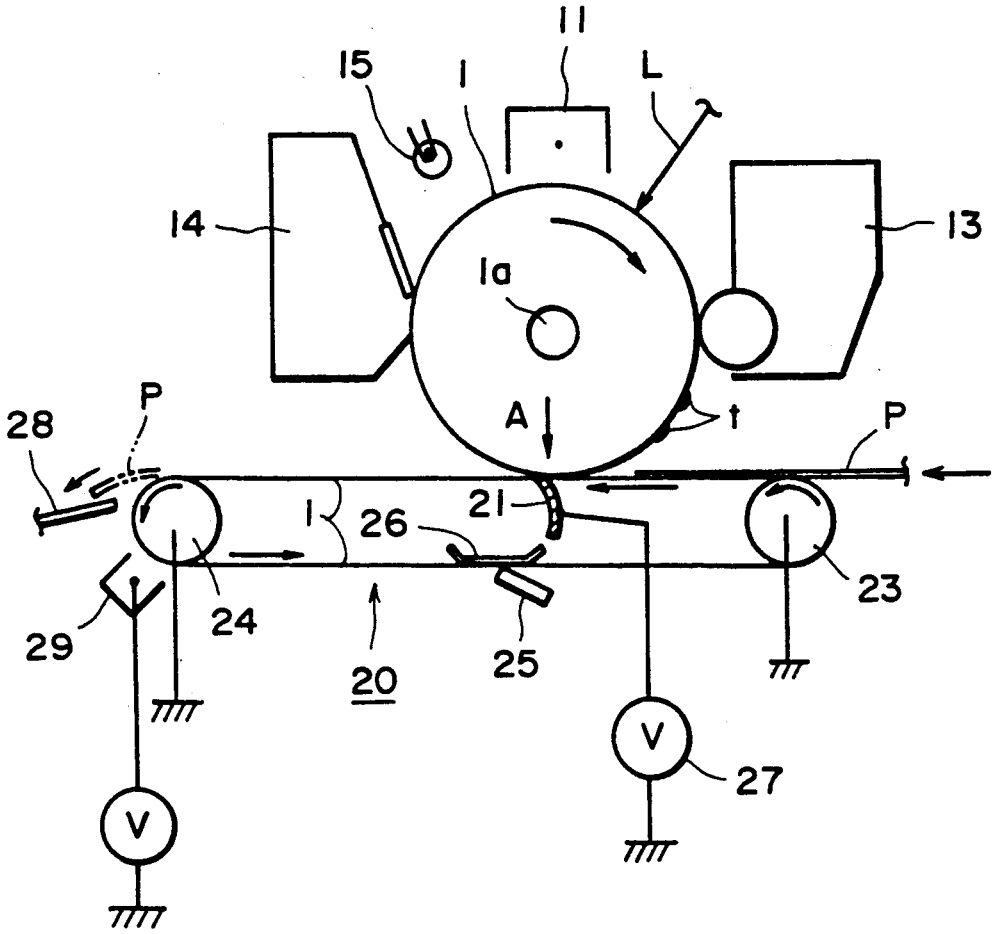
FIGS. 3 and 4 are sectional views of the image forming apparatuses according to other embodiments of the present invention.

Referring to FIG. 3, there is shown a transfer and conveying device according to another embodiment of the present invention. The structure of this embodiment is fundamentally the same as the apparatus of the foregoing embodiment (FIG. 1), but the discharging brush 22 used for the purpose of electrically discharging the transfer belt 2 is not used, and instead, a corona discharger 29 is disposed at a position before the cleaner 25.

The corona discharging device 29 is supplied with a voltage having the same polarity as the transfer charging or an AC voltage. The DC corona discharger can provide sufficient discharging effect, and the amount of ozone production is relatively smaller, and therefore, a positive DC corona discharger is used in this embodiment The current is preferably 100–300 micro-amperes. In this embodiment, the electric discharge is of a non-contact type, and therefore, the electric discharge can be effected before the cleaner 25. Therefore, even if the ozone products by the corona discharge are deposited on the transfer belt 2, most of them are removed by the cleaner 25, by which the amount of ozone product transferred from the transfer belt 2 to the OPC drum 1 is very small. Since the corona discharger 29 is sufficiently distant from the OPC drum 1, that is, it is disposed across the transfer belt 2 from the OPC drum 1, the ozone produced by the corona discharger 29 other than those deposited on the transfer belt 2 does not adversely affect the OPC drum 1.

In this manner, by the disposition of the discharger 29 before the cleaner 25, there is no means opposed or contacted to the transfer belt 2 surface between the cleaner 25 and the OPC drum 1. By this, the matter deposited on the transfer belt 2 is hardly transferred to the OPC drum 1. Therefore, the problem of the flow of the image attributable to the deposition of the low resistant materials can be stably avoided.

Figure 4:
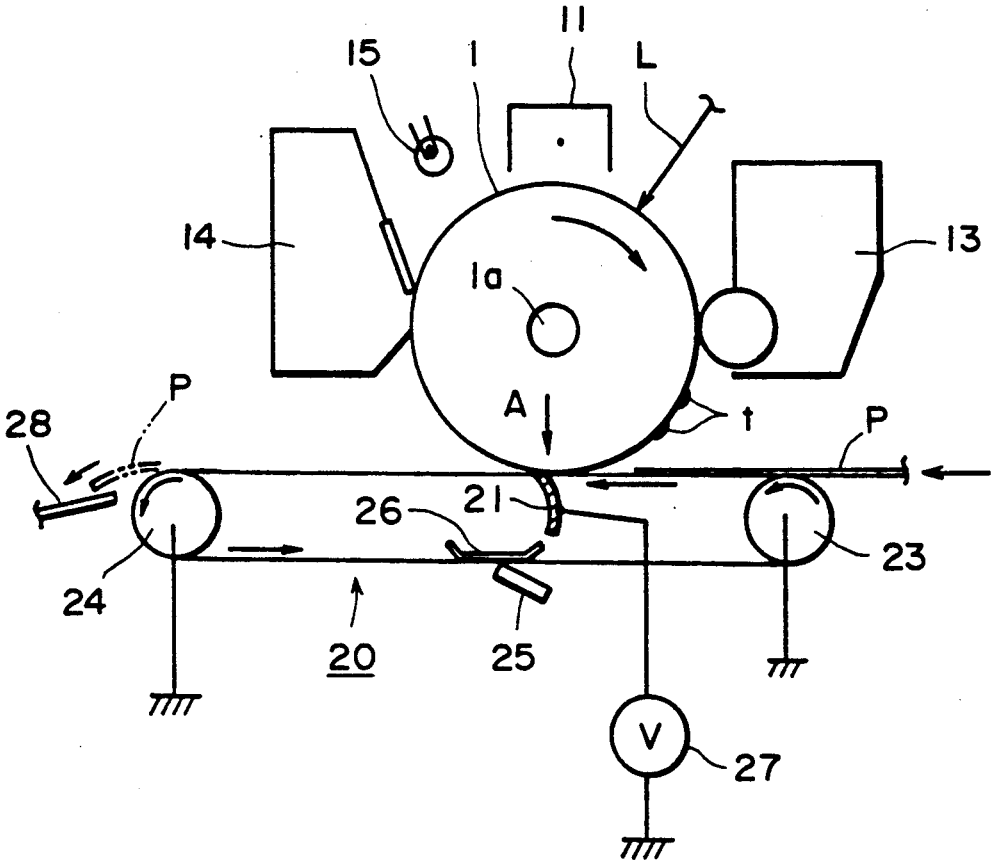

Referring to FIG. 4, there is shown a further embodiment, wherein the transfer belt 2 has a volume resistivity of $10^{10}$–$10^{14}$ ohm·cm. The material thereof may be fluorine contained resin such as polyvinylidene fluoride, polyolefin, polyester, polyurethane, fluorine or polyamide heat curable elastomer. It is extruded into a tube and is cut into a desired dimension in the form of an endless belt. The thickness thereof is 100–300 microns from the standpoint of the strength and the image transfer performance, further preferably it is between 150 and 250 microns.

Further, it is preferable in this embodiment that the conductive elastic blade 21 is supplied with a voltage with a constant current control. This is because with the range of the volume resistivity described above, the electric charge moved through the thickness of the transfer belt 2, and therefore, the possible excess current is prevented by which the problem of the trace of the sheet attributable to the injection of the positive charge into the OPC drum 1 can be avoided.

The constant current control to the conductive elastic blade 2 means that the charge flowing into the transfer belt 2 is directly controlled. Therefore, a constant amount of the transfer charge is in the transfer belt 2 through which the charge is movable, so that the belt is prevented from being charged up. This eliminates the necessity of particular discharging means. For this reason, the means for discharging the surface of the transfer belt 2 is not provided in this embodiment, as shown in FIG. 4.

By applying the transferring electric field by the conductive elastic blade 21 contacted to the $10^{10}$–$10^{14}$ ohm·cm, at a position opposed to the OPC drum 1, the necessity of the particular discharging means can be eliminated, and the accumulated charge of the transfer belt 2 can be sufficiently removed only by the discharging means within the endless belt (only the conductive rollers 23 and 24 on which the belt is trained, in this embodiment). Therefore, no ozone products or the like are deposited on the surface of the transfer belt 2, and in addition, the possibility of the low resistance material being transferred from the transfer belt 2 to the OPC drum 1 can be avoided, and the flow of the image can be stably avoided.

The volume resistivity is defined as a resistance in the direction of the thickness of the belt, which is measured in the following manner.

As shown in FIGS. 5A and 5B, the measuring device includes a first electrode 31 having a diameter of 50 mm, a circular guard electrode 32 enclosing the first electrode 31 with a clearance of 10 mm therebetween, and therefore, having the inner diameter of 70 mm and a second electrode 33 opposed to the first electrode 31 and the guard electrode 32 and having an area which is sufficiently larger than the guard electrode 32.

FIG. 6 shows an equivalent circuit of the measuring device. In consideration of the circuit, the resistance in the direction of the thickness can be obtained from the current I and the voltage V, as follows:

$$e_r \text{ (resistance in the thickness direction)} = 19.6 \times V/I \times t \text{(ohm.19 cm)}$$

(The area of the first electrode is 19.6 ($cm^2$)) where t is the thickness of the belt2.

Since the resistance is dependent upon the voltage V applied, the voltage V is determined as being 100 V in the experiments. The environmental conditions of the measurement is room temperature of 23° C. and 60% humidity, and the transfer belt to be measured has been left in that environment 24 hours.

In the ongoing description, the OPC photosensitive member is in the form of a drum, but it may be in the form of a belt. Further the transfer charging electrode is in the form of a conductive and elastic blade, but is mat be in the form of a conductive roller. However, the blade electrode is preferable because the toner is prevented from being scattered from the transfer material to the photosensitive member (scattered toner is deposited in the no-image area around the image area). In order to further prevent the scattering, it is preferable that the blade is contacted to the belt slightly downstream of the transfer position with respect to the movement direction of the belt, as shown in FIG. 2. By this, the scattering immediately before the transfer position can be prevented.

The image bearing member is not limited to the photosensitive drum, but may be a dielectric drum using a multi-stylus to form the latent image.

Further, in the foregoing embodiment, a reverse development system is used to develop the image bearing member, but the regular developing system can be employed wherein the toner is charged to the polarity opposite to the polarity of the latent image formed on the image bearing member.

As described in the foregoing, according to the present invention, the blurring and the flow of the image can be prevented by using a rotatable transfer rotatable member having a surface layer. The present invention is particularly advantageous when the photosensitive member is of an OPC material. The developing device of the image forming apparatus is a reversal development type, the charge memory and the trace of sheet can be prevented from being produced in the image bearing member, attributable to the image transfer charging action can be avoided. In this embodiment, the rotatable transfer member is used, and therefore, the transfer material can be stably separated and conveyed from the image bearing member.

Further, by use of a blade for the electrode at the back side of the transfer rotatable member, the scattering of the toner can be prevented at the image transfer.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a movable image bearing member;

means for forming an image on said image bearing member; and means for transferring the image formed on said image bearing member by said image forming means onto a transfer material, said transfer means including:

a movable transfer member for moving the transfer material while causing the transfer material to contact the surface of said image bearing member at a transfer position, and an electrode for forming a transfer electric field, said electrode being supplied with a voltage and contacting a surface of said transfer member remote from said image bearing member at said transfer position wherein $$5 \times 10^{-5} L \times Vp \leqq I \leqq 1 \times 10^{-3} \times L\ Vp$$

wherein I is a current in micro ampere to said electrode; Vp is a speed in mm/sec. of movement of the transfer material; and L is a width in mm. of a maximum transfer material measure in a direction perpendicular to the movement direction of the transfer material.

2. An apparatus according to claim 1, wherein said transfer member is in the form of a belt.

3. An apparatus according to claim 2, wherein said transfer member is in the form of an endless belt.

4. An apparatus according to claim 2, wherein said electrode is fixed in a position irrespective of movement of the transfer material.

5. An apparatus according to claim 1, wherein said electrode is in the form of a blade.

6. An apparatus according to claim 5, wherein said blade electrode is contacted to said transfer member codirectionally.

7. An apparatus according to claim 1, wherein said image bearing member includes a photosensitive member and wherein said image forming means includes means for charging the surface of said photosensitive member, exposure means for exposing the surface of said photosensitive member charged by said charging means to light in accordance with image information to form a latent image, and developing means for developing the latent image with toner.

8. An apparatus according to claim 7, wherein said developing means reverse-develops the latent image.

9. An apparatus according to claim 8, wherein a polarity of charge applied to said photosensitive member by said charging mean is the same as a polarity to which the toner is charged.

10. An apparatus according to claim 9, wherein the voltage supplied to the electrode has a polarity opposite to a charging polarity of said charging means.

11. An apparatus according to claim 8, wherein said exposure means exposes said photosensitive member to the light modulated in accordance with image signals indicative of image information.

12. An apparatus according to claim 11, wherein said exposure means includes a laser scanner.

13. An apparatus according to claim 8, wherein the voltage supplied to the electrode has a polarity opposite to a charging polarity of said charging means.

14. An apparatus according to claim 1, further comprising voltage applying means for applying a voltage to said electrode.

15. An apparatus according to claim 14, wherein said voltage applying means is controlled so that a constant current flows through said electrode.

16. An apparatus according to claim 1, wherein said transfer member has a dielectric surface for supporting the transfer material, and wherein the dielectric surface on said transfer member has a volume resistivity of not less than $10^{10}$ ohm·cm.

17. An apparatus according to claim 16 wherein the dielectric surface of said transfer member has a volume resistivity of $10^{10}$–$10^{14}$ ohm·cm.

18. An apparatus according to claim 1, further comprising discharging means for discharging said transfer member after the image transfer.

19. An apparatus according to claim 1, wherein said electrode is out of contact with the transfer member upstream of the transfer position with respect to a movement direction of the transfer material.

20. An apparatus according to claim 1, wherein the electrode is elastic.

21. An apparatus according to claim 1, wherein said transfer member is contactable to said image bearing member at the transfer position.

22. An apparatus according to claim 21, wherein said electrode is contacted to the transfer material at the transfer position.

23. An apparatus according to claim 1, wherein said electrode is contacted to the transfer material at the transfer position.

24. An apparatus according to claim 1, wherein a width of the nip formed between said image bearing member and the transfer material is not less than 3 mm.

25. An apparatus according to claim 1, wherein said electrode is in the form of a blade which has an edge contacting a surface of said transfer member away from the transfer position and within an area corresponding to a contact area between said image bearing member and said transfer member, wherein said electrode extends away from said transfer member in an upstream direction with respect to a movement direction of the transfer member.

26. An image forming apparatus, comprising:

a movable image bearing member;

image forming means for forming an image on said image bearing member; and image transfer means for transferring the image formed on said image bearing member by said image forming means onto a transfer material, said transfer means including:

a movable transfer member, contacting said image bearing member, for moving the transfer material while causing the transfer material to contact the surface of said image bearing member at a transfer position, and an electrode blade for forming a transfer electric field, said electrode blade being supplied with a voltage, and an edge thereof contacting a surface of said transfer member away from the transfer position and within an area corresponding to a contact area between said image bearing member and said transfer member, wherein said electrode blade contacts said transfer member co-directionally, and wherein said electrode blade extends away from said transfer member in an upstream direction with respect to a movement direction of the transfer member.

27. An apparatus according to claim 26, wherein said transfer member as a surface dielectric layer.

28. An apparatus according to claim 27, wherein said transfer member is in the form of a belt.

29. An apparatus according to claim 28, wherein said transfer member is in the form of an endless belt.

30. An apparatus according to claim 27, wherein the dielectric surface of said transfer member has a volume resistivity of not less than $10^{10}$ ohm·cm.

31. An apparatus according to claim 30, wherein the dielectric surface of said transfer member has a volume resistivity of $10^{10}$–$10^{14}$ ohm·cm.

32. An apparatus according to claim 26, further comprising voltage applying means for applying a voltage to said electrode.

33. An apparatus according to claim 32, wherein said voltage applying means is controlled so that a constant current flows through said electrode.

34. An apparatus according to claim 26, wherein the electrode is elastic.

35. An apparatus according to claim 26, wherein said transfer member is contactable to said image bearing member at the transfer position.

36. An apparatus according to claim 35, wherein said electrode is contacted to the transfer material at the transfer position.

37. An apparatus according to claim 26, wherein said electrode is contacted to the transfer material at the transfer position.

38. An apparatus according to claim 26, wherein a width of the nip formed between said image bearing member and the transfer material is not less than 3 mm.

39. An apparatus according to claim 26, wherein said electrode blade is out of contact with the transfer member upstream of the transfer position with respect to a movement direction of the transfer material.

40. An apparatus according to claim 26, wherein said electrode blade has a thickness of 0.1–1 mm.

41. An apparatus according to claim 1, wherein said transfer member is rotatable.

* * * * *

UNITED STATES PATENT AND TRADEMARK OFFICE

CERTIFICATE OF CORRECTION

PATENT NO. : 5,198,863

DATED : March 30, 1993

INVENTOR(S) : MASAHIRO GOTO, ET AL.

It is certified that error appears in the above-indentified patent and that said Letters Patent is hereby corrected as shown below:

COLUMN 1

Line 54, "attract" should read --attracts--.

COLUMN 3

Line 41, "FIG. 6," should read --FIG. 6".

COLUMN 4

Line 27, "patters" should read --matter--.

COLUMN 5

Line 65, "$5x10^{-5}L\ Vp \leq I1x10^{-3}xL\ Vp$ (mm/sec)" should read --$5x10^{-5}L\ Vp \leq I \leq 1x10^{-3}xL\ Vp$ (mm/sec)--

COLUMN 6

Line 3, "$I \leq 5x10^{-5}L\ Vpp$," should read --$I \leq 5x10^{-5}L\ Vp$,--.

Line 62, "charge," should read --charge--.

Line 66, "close-contactness" should read --close contact--.

COLUMN 7

Line 67, "ment The" should read --ment. The--.

UNITED STATES PATENT AND TRADEMARK OFFICE

CERTIFICATE OF CORRECTION

PATENT NO. : 5,198,863

DATED : March 30, 1993

INVENTOR(S) : MASAHIRO GOTO, ET AL.

It is certified that error appears in the above-indentified patent and that said Letters Patent is hereby corrected as shown below:

COLUMN 8

Line 24, "fluorine contained" should read --fluorine-containing--.

Line 26, "heat curable" should read --heat-curable--.

Line 42, "blade 2" should read --blade 21--.

Line 52, "the $10^{10}$-$10^{14}$" should read --the transfer belt 2 which has the volumn resistivity of $10^{10}$-$10^{14}$--.

COLUMN 9

Line 14, "(ohm.19 cm)" should read --(ohm.cm)--.

Line 17, "belt2." should read --belt 2--.

Line 24, "ongoing" should read --foregoing--.

Line 26, "Further" should read --Further,--.

Line 27, "is mat" should read --it may--.

Line 50, "rotatable" (second occurrence) should be deleted.

Line 51, "surface" should read --dielectric surface--.

UNITED STATES PATENT AND TRADEMARK OFFICE

CERTIFICATE OF CORRECTION

PATENT NO. : 5,198,863

DATED : March 30, 1993

INVENTOR(S) : MASAHIRO GOTO, ET AL.

It is certified that error appears in the above-indentified patent and that said Letters Patent is hereby corrected as shown below:

COLUMN 10

Line 25, "micro ampere" should read --microampere--.

Line 57, "mean" should read --means--.

COLUMN 12

Line 18, Q: "as" should read --has--.

Signed and Sealed this

Fifteenth Day of March, 1994

Bruce Lehman

*Attest:*

BRUCE LEHMAN

*Attesting Officer*

*Commissioner of Patents and Trademarks*